United States Patent [19]

Swanson

[11] Patent Number: 4,502,602

[45] Date of Patent: Mar. 5, 1985

[54] DISPLAY FIXTURE WITH REMOVABLE ARM FOR USE WITH PERFORATED BOARD

[76] Inventor: Russell K. Swanson, 3212 Coleman Rd., Kansas City, Mo. 64111

[21] Appl. No.: 405,290

[22] Filed: Aug. 4, 1982

[51] Int. Cl.[3] ..... A47F 7/00

[52] U.S. Cl. ..... 211/59.1; 211/57.1; 248/220.4

[58] Field of Search ..... 211/59.1, 57.1, 54.1, 211/105.1; 248/220.1, 220.2, 220.3, 220.4, 221.1

[56] References Cited

U.S. PATENT DOCUMENTS 3,452,954 7/1969 Lucietto et al. ..... 211/59.1 X

FOREIGN PATENT DOCUMENTS 2758582 6/1979 Fed. Rep. of Germany ... 248/220.4

2386718 12/1978 France ..... 211/59.1

*Primary Examiner*—Ramon S. Britts

*Assistant Examiner*—Blair M. Johnson

*Attorney, Agent, or Firm*—Schmidt, Johnson, Hovey & Williams

[57] ABSTRACT

An improved display fixture with a removable arm is provided which allows the user to quickly and easily replenish the fixture with display items in such a manner that the newly loaded display items are positioned at the rear of the display fixture. The display fixture preferably includes a U-shaped base which is attached to an upright display support structure using any convenient means. The display fixture is also provided with arm structure compatible with the desired display merchandise, with the arm being removable from the display fixture such that display merchandise can be replenished by loading the rear connection end of the arm. The U-shaped base is apertured removably receiving the rear end of the arm structure, in a cantilever fashion.

8 Claims, 6 Drawing Figures

Fig. 1.
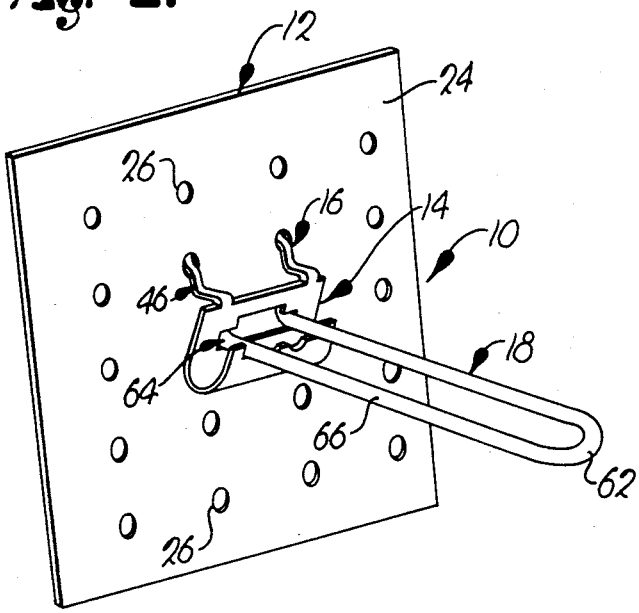
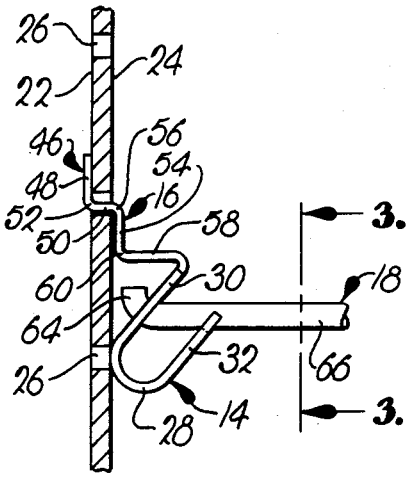
Fig. 2.
Fig. 3.
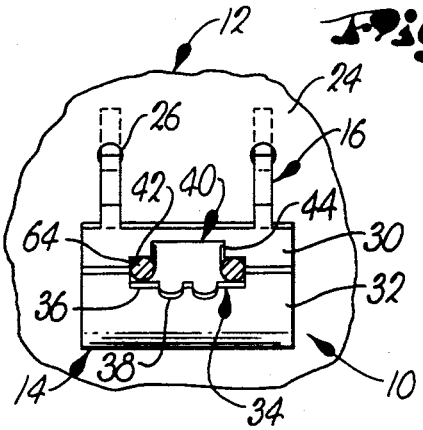
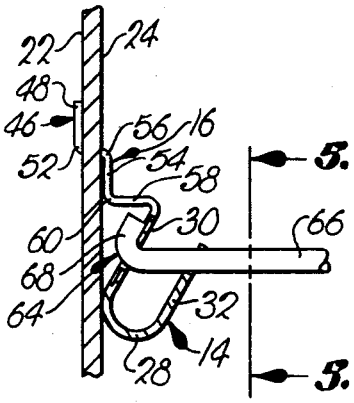
Fig. 4.
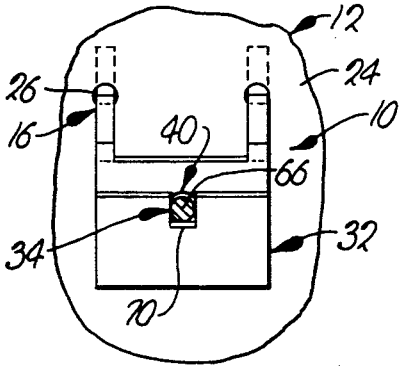
Fig. 5.
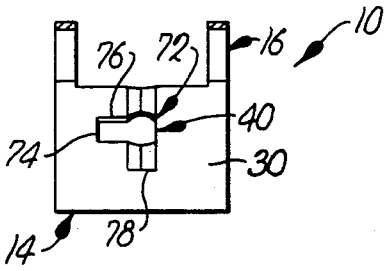
Fig. 6.

DISPLAY FIXTURE WITH REMOVABLE ARM FOR USE WITH PERFORATED BOARD

BACKGROUND OF THE INVENTION

1. Field of the Invention

The present invention is concerned with an improved display fixture with a removable arm especially well suited for the display of a variety of merchandise. More particularly, it is concerned with a display fixture that is suited for any merchandise where it is desirable to sell the oldest merchandise first, such as perishable goods; the removable arm of the fixture allows loading of display merchandise at the rearward end of the arm so that old merchandise is displayed at the front for first sale, while newly loaded merchandise is retained for later sale.

2. Description of the Prior Art

As any merchant of perishable goods will attest, it is important to sell the oldest merchandise first prior to their spoilage. It is therefore necessary to place the oldest perishable goods closest to the consumer and to restock the new display merchandise behind the older goods. Such a procedure is generally referred to as rotating the goods. When the merchandise is supported on a display fixture, the rotation procedure can be particularly time consuming in that the older goods must first be removed, the new merchandise loaded onto the display fixture, and the old merchandise put back into a first sale position.

One type of known display fixture which is particularly inefficient from the standpoint of rotation of goods includes the type having the arm supporting the display merchandise permanently attached to a base support structure presenting a unitary construction. Because with this type of display fixture rear loading of merchandise is impossible, they are particularly inadequate where the oldest merchandise is sought to be sold first, as is the case with perishable goods. Accordingly, there is a real and heretofore unsatisfied need in the art for a display fixture that permits loading from the rear and, concurrently, adequately displays the merchandise.

SUMMARY OF THE INVENTION

The problems associated with conventional display fixtures are largely overcome by the present invention. Broadly speaking, the display fixture of this invention includes a base which is attached to an upright support surface using whatever method is convenient and available, an elongated arm structure having a free end and a coupleable end for supporting the display merchandise, and structure for coupling the arm to the base in a supported, cantilever manner. Preferably, the arm structure, when coupled with the base, extends outwardly and generally horizontally from the base. The coupling structure allows the display arm structure to be locked into place for display and yet allows for selective decoupling and removal of the arm structure from the base for easy, rearward replenishing and rotation of display merchandise.

In particularly preferred forms, the base is attached to the upright support surface by a plurality of angled, space-apart hooks, configured and arranged to extend through perforations in the upright support surface and engage the rear wall of the support surface. Generally, the arm structure has at least one elongated support member having a generally L-shaped terminal section at one end which, when inserted through the base aperture, retains the arm in place. The base is advantageously generally U-shaped in cross section presenting a rearward apertured support surface-engaging portion, and a forward portion spaced from and generally parallel to, the rearward portion of the base. The forward portion of the base preferably has at least one indentation for engaging and supporting the extended arm structure, when the terminal section thereof is received in the base aperture.

BRIEF DESCRIPTION OF THE DRAWING

FIG. 1 is a perspective view of a display fixture in accordance with the invention mounted on an upright perforated support surface;

FIG. 2 is a fragmentary side view in partial vertical section of the display fixture, depicting the attachment of the fixture to the support surface;

FIG. 3 is a vertical sectional view taken on line 3—3 of FIG. 2 which illustrates the aperture and the indentation in the supporting base;

FIG. 4 is a side view in partial vertical section of another display fixture in accordance with the invention, wherein the fixture has only a single support arm;

FIG. 5 is a vertical sectional view taken along line 5—5 of FIG. 4; and FIG. 6 is a rear view of the base of the display fixture depicted in FIGS. 4 and 5.

DESCRIPTION OF THE PREFERRED EMBODIMENTS

Turning now to the drawings, FIGS. 1–3 illustrate the preferred embodiment of the invention, in the form of a display fixture 10 for mounting on an upright, perforated support surface 12. Broadly speaking, the display fixture 10 includes base structure 14 removably attachable to the surface 12, attachment means 16 for securing the base structure 14 to the upright support surface 12, removable, cantilevered arm structure 18 for supporting the display merchandise, and coupling means 20 for receiving and supporting the arm structure 18 and permitting the selective decoupling thereof.

Although display fixture 10 may be used with any type of upright support surface 12, in particularly preferred forms the upright support surface is as illustrated in FIGS. 1 and 2. The support surface 12 includes a rear face 22, an opposed front face 24 and a plurality of regularly spaced perforations 26 extending between the front face 24 and the rear face 22.

Base structure 14 for attachment to the upright support surface 12 includes a body 28 of generally U-shaped cross-sectional configuration presenting a rearward, support-engaging portion 30 and a spaced, opposed forward portion 32 generally parallel with the rearward portion 30. Turning to FIG. 3, it is seen that the forward portion 32 has structure defining at least one indentation 34 in the upper margin thereof. In particularly preferred forms, the indentation structure 34 presents a pair of outboard, laterally spaced-apart indentations 36 separated by a pair of inboard, laterally spaced-apart indentations 38.

The rearward portion 30 of the base structure 14 includes structure defining an aperture 40 extending therethrough. In the embodiment of FIG. 3, the aperture 40 is in the form of an elongated, narrow, generally rectangular bottom cutout portion 42 and a shorter, generally rectangular upper cutout portion 44 centered in relation to the bottom portion 42 and extending upwardly therefrom. Thus, the combination of the upper and bottom cutout portions 42, 44 presents a continuous opening.

The means 16 is utilized to attach base structure 14 to the surface 12. The attachment means 16 includes a plurality of spaced-apart, angled hooks 46 configured and arranged for extending through the perforations 26. As best seen in FIG. 2, each hook 46 includes: a first leg 48 adjoining the rear face 22 of the upright support surface 12 and extending upward from the corresponding perforation 26; a second leg 50, connected to the bottom of the first leg 48 by means of a generally right angle bend 52 and extending through the corresponding perforation 26; a third leg 54, connected to the second leg 50 by a generally right angle bend 56, extending downwardly from the second leg 50 and adjoining the front face 24 of the upright support surface 12 beneath the corresponding perforation 26; and a fourth leg 58, connected to the third leg 54 by a generally right angle bend 60, extending outwardly from the front face 24 of the upright support surface 12 in a generally horizontal fashion, the outer end of the fourth leg 58 being connected to the rearward portion 30 of the base structure 14 as shown. In this regard it is seen that the rearward portion 30 is obliquely oriented relative to the fourth leg 58 in engagement with the front face 24 of the upright support surface 12 at a point below the fourth leg 48.

Elongated arm structure 18 has a free end 62 and a coupleable end 64. The arm structure 18 presents a pair of parallel, spaced-apart, interconnected support members 66 each with a corresponding terminal section of generally L-shaped configuration 68 at the coupleable end thereof.

In use, the display fixture 10 is fastened to the support surface 12 by the insertion of the hooks 46. In the preferred embodiment the support members 66 of the arm structure 18 are manually compressed toward each other for insertion into, and removal from, the aperture 40. It should be appreciated that when the arm structure 18 is in the compressed position it may be inserted and removed by clearing inboard indentations 38 with the L-shaped terminal sections 68 extending through the aperture 40 via the upper cutout 44. The inserted arm structure 18 is coupled when released from the compressed position, allowing the L-shaped terminal sections 68 to engage the base body 28 and the support members 66 to be secured in outboard indentations 36. The arm structure 18 in the coupled position presents a supported cantilevered structure extending outwardly and generally horizontally from the base 14 and thus is capable of supporting display merchandise. For replenishment of the display merchandise, the coupleable end 64 is again compressed allowing decoupling from the base for reloading at the coupleable end 64.

Turning now to FIGS. 4–6, the second embodiment of the invention is illustrated. In this case the arm structure 18 consists of a single support member 66 with an L-shaped terminal section 68 at the coupleable end 64 thereof. The indentation structure 34 in the forward base portion 32 includes a single, centrally located indentation 70 of sufficient size to accommodate the arm structure support member 66. The aperture 40 is configured to present a singular, generally rectangular cutout portion 72 having a width 74 slightly greater than the cross section of the arm structure support member 66 and a length 76 sufficient to accommodate the insertion of the L-shaped terminal section 68 of the arm structure support member 66. A groove 78 is incorporated into the back of rear base portion 30 generally perpendicular to the aperture 40. All other portions of the display fixture 10 are identical with the first-described embodiment, and accordingly, the corresponding reference numerals have been applied.

In practice the operation of the second embodiment is similar to the first embodiment with the method of coupling and decoupling being the greatest dissimilarity. In the second embodiment the support member 66 is coupled to the base structure 14 by inserting the L-shaped terminal section 68 through the aperture 40. The terminal section 68 is then locked into groove 78 by rotating the support member 66 one quarter turn. The support member 66 is additionally supported by the single indentation 70 in the forward base portion 32. Decoupling is accomplished by reversing the procedure.

It will thus be seen that the present invention provides an improved display fixture with a removable arm which allows the user to quickly and easily replenish the fixture with display items in such a manner that the newly loaded display items are positioned at the rear of the display fixture. This design substantially solves many of the problems which have heretofore been experienced with conventional display fixtures.

I claim:

1. A display fixture for mounting on a perforated upright support surface having opposed front and rear faces, and structure defining a series of perforations extending between said front and rear faces, said fixture comprising:

(a) a base structure for attachment to said upright support surface, including a body of generally U-shaped cross-sectional configuration with respect to a vertical axis presenting a rearward portion, and a spaced, opposed forward portion;

structure defining an aperture extending through said rearward portion of said base; and structure defining at least one indentation in said forward portion of said base;

(b) means for attaching said base to said perforated upright support structure and including a plurality of spaced-apart, surface-engaging fastener members for insertion into corresponding perforations, each of said fastener members having a first leg, a second leg, a third leg, and a fourth leg connected by a series of generally right angle bends, said first leg adjoining the rear face of said upright support surface and extending upward from said corresponding perforation, said second leg being connected to the bottom of said first leg and extending through said corresponding perforation, said third leg being connected to said second leg and extending downwardly from said second leg and adjoining said front face of said upright support surface beneath said corresponding perforation, said fourth leg being connected to said third leg and extending outwardly from said front face of said upright support surface in a generally horizontal fashion, the outer end of said fourth leg being connected to the rearward portion of said base structure, said rearward portion being obliquely oriented relative to said fourth leg and in engagement with the front face of said upright support surface at a point below the fourth leg;

(c) an elongated arm structure having at least one support member each with a terminal section of generally L-shaped configuration at one end thereof, each of said terminal sections being received within said base aperture for releasably securing said terminal sections to the base structure, said arm extending outwardly from the base structure and being received within said indentation for supporting the arm structure.

2. The display fixture as set forth in claim 1, wherein said arm structure comprises two parallel, spaced-apart, interconnected support members cooperatively presenting a unitary arm structure, said terminal sections of said parallel support members being manually compressible toward each other for insertion into, and removal from, said aperture.

3. The display fixture as set forth in claim 2, said forward portion including a pair of outboard laterally spaced-apart indentations separated by a pair of inboard, laterally spaced-apart indentations of sufficient size to accommodate said support members in the compressed condition thereof, said inboard indentations extending below the bottom of said outboard indentations.

4. The display fixture as set forth in claim 2, wherein said aperture consists of an elongated, narrow, generally rectangular bottom cutout portion of sufficient width to accommodate the cross section of said arm structure support members and a shorter, generally rectangular upper cutout portion, the latter being centered in relation to said bottom cutout portion and extending upwardly from said bottom cutout portion such that the combination of said upper and bottom cutout portions form an opening of sufficient size to allow the L-shaped terminal sections of said arm structure to be inserted therein, and removed therefrom, when compressed together.

5. The display fixture as set forth in claim 1, wherein said arm structure comprises one support member.

6. The display fixture as set forth in claim 5, wherein said indentation in said forward base portion includes a single, centrally located indentation of sufficient size to accommodate the arm structure support member.

7. The display fixture as set forth in claim 5, wherein said aperture is configured to present a singular, generally rectangular cutout portion having a width slightly greater than the cross section of said arm structure support member and whose length is sufficient to accommodate the insertion of said L-shaped terminal section of said arm structure support member.

8. A display fixture for mounting on a perforated upright support surface having opposed front and rear faces, and structure defining a series of perforations extending between said front and rear faces, said fixture comprising:

(a) a base structure for attachment to said upright support surface, including
a body of generally U-shaped cross-sectional configuration with respect to a vertical axis presenting a rearward portion, and a spaced, opposed forward portion;
structure defining an aperture extending through said rearward portion of said base; and
structure defining at least one indentation in said forward portion of said base;

(b) means for attaching said base to said perforated upright support surface and including a plurality of spaced-apart, surface-engaging fastener members for insertion into corresponding perforations, each of said fastener members having a plurality of legs connected by a series of generally right angle bends, the normally lowermost of said legs extending outwardly from said front face of said upright support surface in a generally horizontal position, the outer end of said lowermost leg being connected to the rearward portion of said base structure, said rearward portion being obliquely oriented relative to said lowermost leg and in engagement with the front face of said upright support surface at a point below the leg; and (c) elongated arm structure having at least one support member with a terminal section of generally L-shaped configuration at one end thereof, said terminal section being received within the aperture in the rearward portion of said base for releasably coupling said terminal section to the base structure, said arm extending outwardly from said rearward portion of the base structure and being received within said indentation in the forward portion of the base structure for supporting the arm structure.

* * * * *